US006966797B2

(12) United States Patent
Ko

(10) Patent No.: US 6,966,797 B2
(45) Date of Patent: Nov. 22, 2005

(54) HIGH-SPEED CABLE ASSEMBLY

(75) Inventor: David (Tso-Chin) Ko, Fullerton, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/737,434

(22) Filed: Dec. 15, 2003

(65) Prior Publication Data

US 2005/0130496 A1 Jun. 16, 2005

(51) Int. Cl.[7] ..... H01R 9/03
(52) U.S. Cl. ..... 439/610
(58) Field of Search ..... 439/610, 607, 439/98, 930, 108, 578–585

(56) References Cited

U.S. PATENT DOCUMENTS 4,592,612 A * 6/1986 Kikuta ..... 439/610
4,781,623 A * 11/1988 Philippson et al. ..... 439/670
4,838,808 A * 6/1989 Fujiura ..... 439/357
5,338,227 A * 8/1994 Nakamura ..... 439/607
5,380,223 A 1/1995 Marsh et al.
5,718,608 A * 2/1998 Guiol ..... 439/610
6,162,086 A 12/2000 Kuo
6,179,662 B1 1/2001 Kuo
6,231,374 B1 * 5/2001 Kuo ..... 439/455
6,413,112 B2 * 7/2002 Semmeling et al. ..... 439/358
6,811,438 B1 * 11/2004 Ko ..... 439/607

* cited by examiner

*Primary Examiner*—Alexander Gilman
(74) *Attorney, Agent, or Firm*—We Te Chung

(57) ABSTRACT

A cable assembly (1) includes an insulative housing (2) having a number of terminals (3) received therein, a metallic shielding (4) at least partially enclosing the housing and defining a wall (424) with an opening (4242) therein, a conductive adapter (5) soldered to the shielding and having a tubular connecting portion (52) extending outward away from the wall and a round cable (6) including a bundle of wires (60) enclosed in an EMI (Electro Magnetic Interference) shielding (62). The wires extend through the opening to electrically connect with the terminals under a condition that the tubular connecting portion engageably and electrically enclosing the EMI shielding.

8 Claims, 4 Drawing Sheets

HIGH-SPEED CABLE ASSEMBLY

CROSS-REFERENCE TO RELATED APPLICATIONS

Relevant subject matter is disclosed in U.S. patent application Ser. No. 10/431,148 filed on May 6, 2003 and entitled "HIGH-SPEED LOW PROFILE CABLE ASSEMBLY WITH IMPROVED EMI SHIELDING" and Ser. No. 10/650,384 filed on Aug. 27, 2003 and entitled "HIGH-SPEED LOW PROFILE CABLE ASSEMBLY", all of which are invented by the same inventor and assigned to the same assignee as this patent application.

BACKGROUND OF THE INVENTION

1. Field of the Invention

The present invention relates to a cable assembly, and particularly to a high-speed cable assembly with a cable electrically connecting to a shielding of an electrical connector to thereby ensuring good electrical performance.

2. Description of Related Art

A cable assembly is commonly used in many electronic devices, such as desktop computers and notebook computers. The cable assembly typically includes a cable and two cable end connectors respectively terminated at opposite ends of the cable. The cable can be a coaxial cable, a flat cable or a multi-wire round cable. The cable is electrically connected with terminals of the cable end connectors by several commonly used connecting technologies, such as soldering, crimping and IDC (Insulation Displacement Contact).

As miniaturization of the electronic devices becomes more prevalent, the cable assembly used to transmit signals in such devices is accordingly required to have a small dimension, such that the cable assembly do not occupy too much space in the device. Further, with the development of high-speed signal transmission technology, a metallic shielding is commonly employed to attach to the cable assembly in order to prevent EMI (Electro Magnetic Interference) from outer environments, thereby ensuring the cable assembly reliably transmitting high-speed signals.

Attaching a metallic shielding onto an insulative housing of a cable end connector has been widely practiced in the art, and pertinent examples of such shieldings are disclosed in U.S. Pat. Nos. 5,380,223, 6,162,086 and 6,179,662.

U.S. Pat. No. 5,380,223 discloses a cable assembly having a metallic shielding. The cable assembly comprises a housing insert with plural contacts retained therein and a cable electrically connecting with the contacts. The metallic shielding comprises an upper and a lower shield members secured with each other to define an interior space for receiving the housing insert therein. The upper and the lower shield members each are formed with an ear extending rearwardly from a rear end of a shield body thereof to commonly crimp a braided shield of the cable to effect grounding. Due to weak mechanical strength of a connecting portion between the ear and the shield body, the ear is apt to breakdown from the shield body. Therefore, the grounding effect of the cable assembly is adversely affected.

Hence, an improved cable assembly is required to overcome the disadvantages of the related art.

SUMMARY OF THE INVENTION

Accordingly, a first object of the present invention is to provide a cable assembly having a metallic shielding reliably and electrically connecting with a cable to ensure an enhanced electrical performance.

A second object of the present invention is to provide a metallic shielding for a cable assembly, the shielding being conveniently attached to an insulative housing of the cable assembly and ensuring reliable EMI protection for the cable assembly.

In order to achieve the objects set forth, a cable assembly in accordance with the present invention comprises an insulative housing having a plurality of terminals received therein, a metallic shielding at least partially enclosing the housing and defining a wall with an opening therein, a conductive adapter soldered to the shielding and having a tubular connecting portion extending outward away from the wall and a round cable including a bundle of wires enclosed in an EMI (Electro Magnetic Interference) shielding. The wires extend through the opening to electrically connect with the terminals under a condition that the tubular connecting portion engageably and electrically enclosing the EMI shielding.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
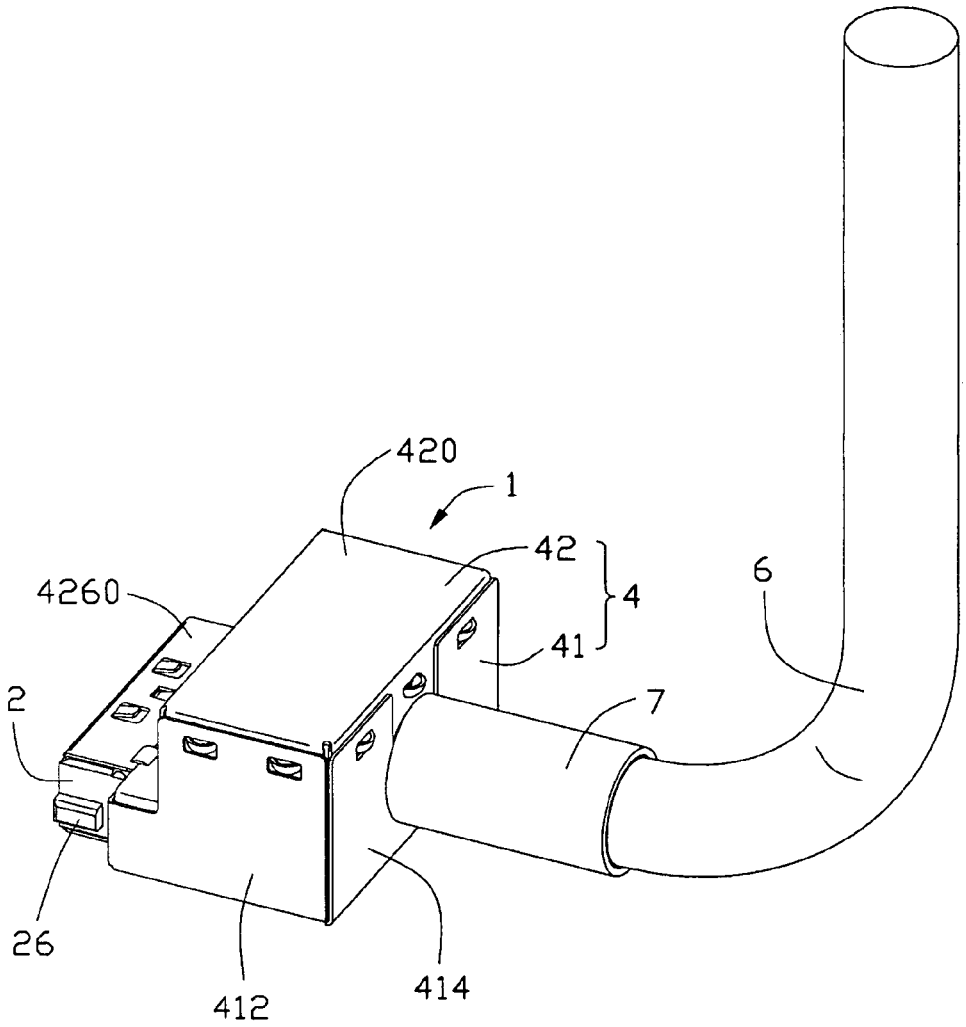
FIG. 1 is a bottom assembled perspective view of a cable assembly in accordance with the present invention.
Figure 2:
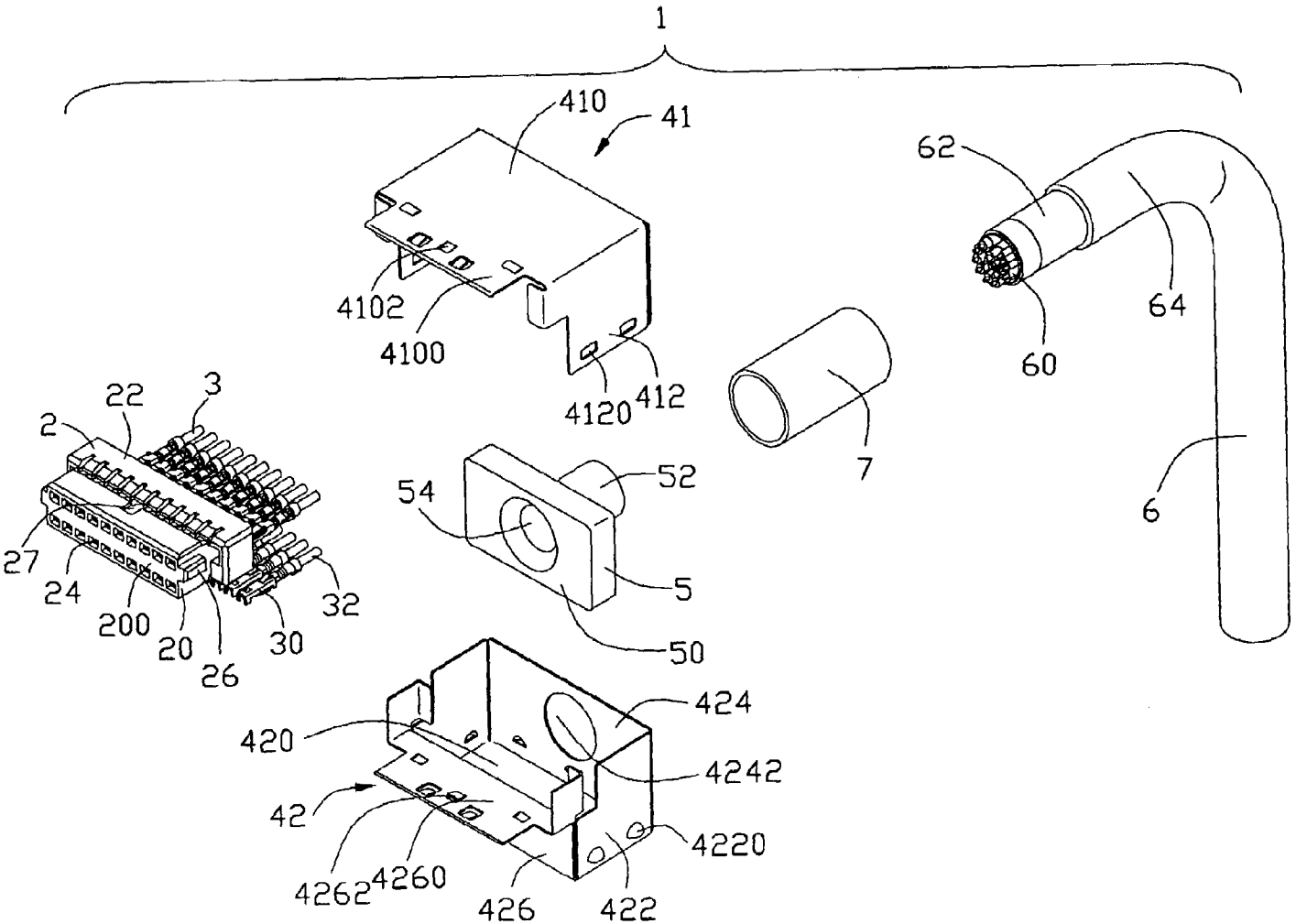
FIG. 2 is a top exploded perspective view of the cable assembly shown in FIG. 1.

Referring to FIGS. 1 and 2, a cable assembly 1 in accordance with the present invention comprises an insulative housing 2 defining a longitudinal direction thereof, a plurality of terminals 3 adapted to be received in the housing 2, a metallic shielding 4 adapted to be attached to the housing 2, an adapter 5 adapted to be secured to the shielding 4, a cable 6 adapted to extend through the adapter 5 to electrically connect with the terminals 3, and an insulative sleeve 7 adapted to secure the adapter 5 and the cable 6 together.

The housing 2 has a front mating portion 20 with a mating face 200 facing toward a complementary connector (not shown) and a rear body portion 22 extending rearwardly from the front mating portion 20. The housing 2 defines a plurality of passageways 24 extending therethrough along a front-to-back direction and with the contacts 3 received therein. A pair of projections 26 is formed on opposite sides of the front mating portion 20 for coupling in a corresponding pair of recesses of the complementary connector to provide polarized mating of the cable assembly 1 and the complementary connector. A pair of cutouts 27 is defined in a top face and a bottom face of the mating portion 20. Each terminal 3 includes a contacting portion 30 at a front end thereof for mating with the complementary connector and a crimping portion 32 at a rear end thereof to mechanically and electrically connect with the cable 6.

Figure 3:
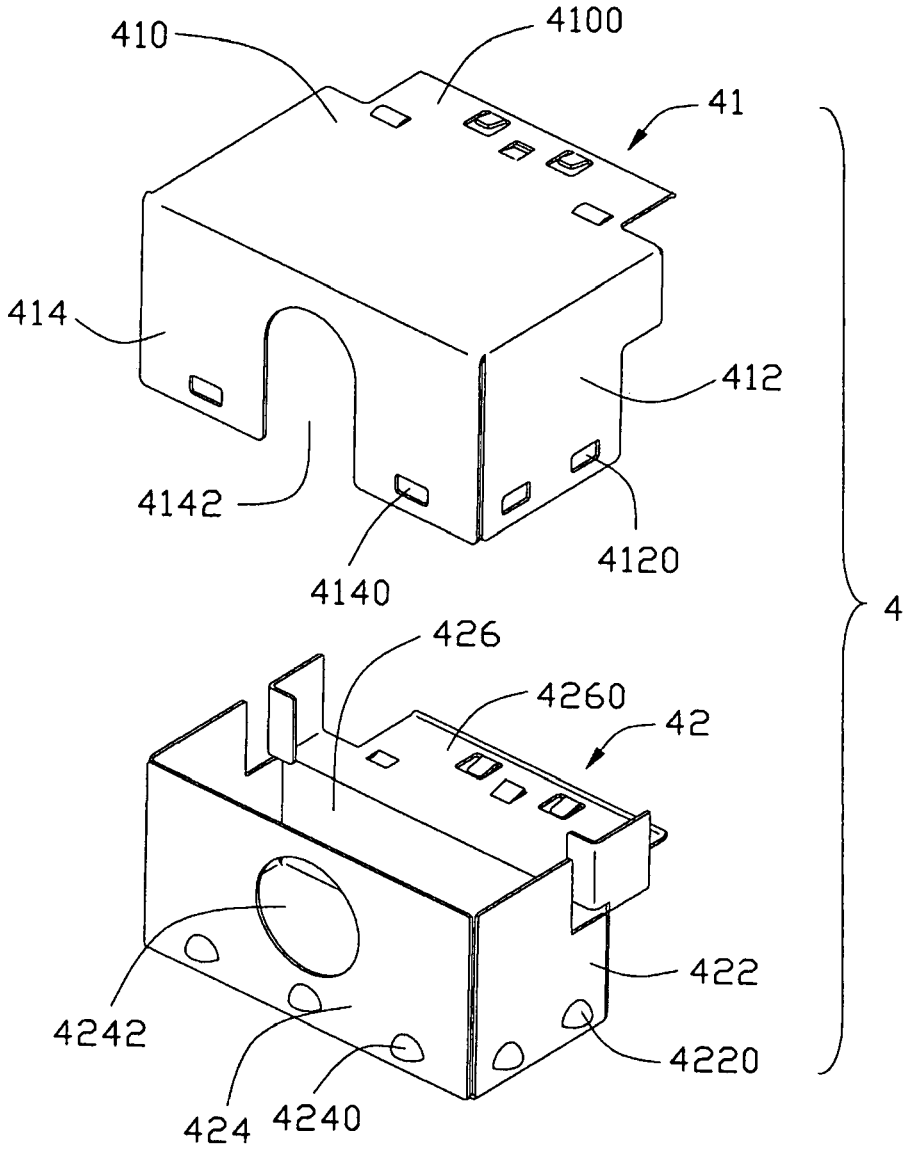
FIG. 3 is an exploded perspective view of a metallic shielding of the cable assembly.

Referring to FIG. 3 in conjunction with FIG. 2, the shielding 4 is formed by stamping and bending metallic sheet material. The shielding 4 includes a first shield member 41 and a second shield member 42 coupled with the first shield member 41. The first shield member 41 comprises a top wall 410, two opposite side walls 412 extending downwardly from opposite ends of the top wall 410 and a rear wall 414 extending downwardly from a rear edge of the top wall 410. The top wall 410 has a first tongue portion 4100 at a front end thereof for being positioned on the top face of the front mating portion 20. The first tongue portion 4100 has a tab 4102 formed thereon for engaging with the cutout 27 on the top face of the mating portion 20. The side walls 412 and the rear wall 414 respectively define a plurality of recesses 4120, 4140 therein. The rear wall 414 defines a channel 4142 at a middle portion thereof.

The second shield member 42 comprises a bottom wall 420, two opposite side walls 422 extending upwardly from opposite ends of the bottom wall 420, a rear wall 424 extending upwardly from a rear edge of the bottom wall 420, and a front wall 426 extending upwardly from a front edge of the bottom wall 420. A second tongue portion 4260 extends forwardly from a top edge of the front wall 426 for being positioned on the bottom face of the front mating portion 20. The second tongue portion 4260 has a tab 4262 formed thereon for engaging with the cutout 27 on the bottom face of the mating portion 20. The side walls 422 and the rear wall 424 respectively have a plurality of bulges 4220, 4240 formed thereon. The rear wall 424 defines an opening 4242 at a middle portion thereof.

Figure 4:
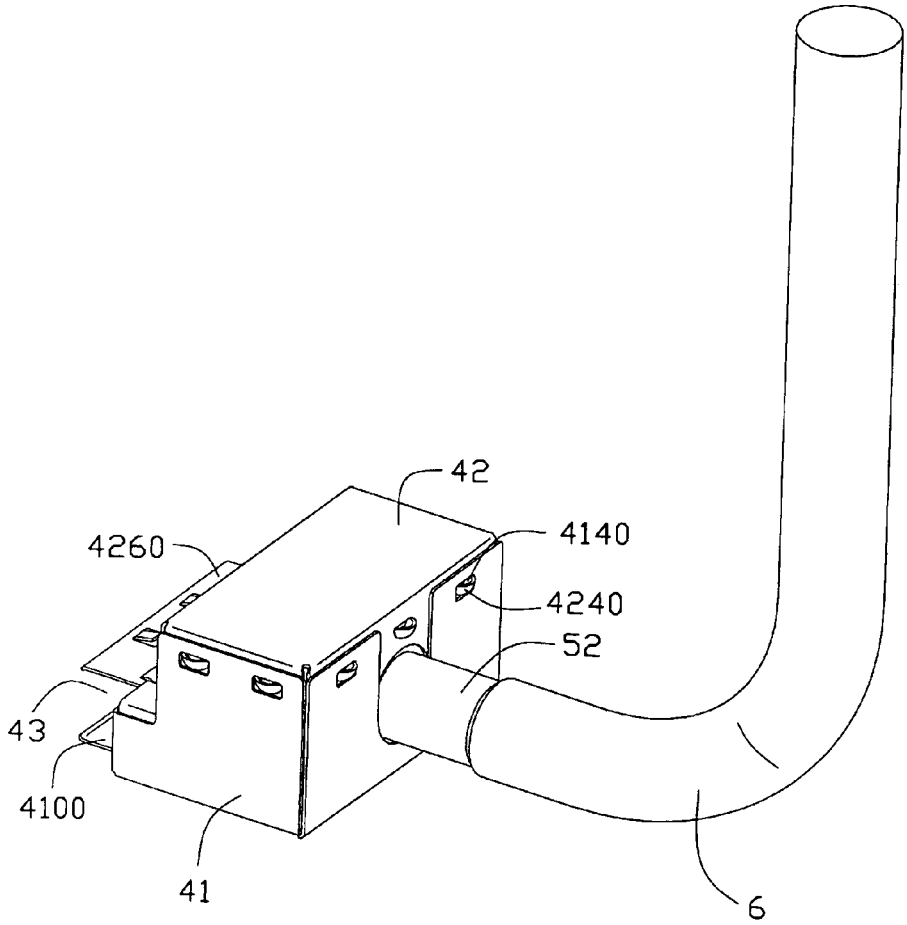
FIG. 4 is a view similar to FIG. 1, but not showing a housing and a sleeve of FIG. 1.

Referring to FIG. 4, when the first and the second shield members 41, 42 are coupled together, the side walls 412 of the first shield member 41 are coupled with the side walls 422 of the second shield member 42 by snapping the bulges 4220 into the recesses 4120. At the same time, the rear wall 414 of the first shield member 41 is coupled with the rear wall 424 of the second shield member 42 by snapping the bulges 4240 into the recesses 4140. The assembled first and second shield members 41, 42 cooperatively define therein a large cavity (not labeled) with an L-shaped cross-section along the longitudinal direction of the housing, and with a small receiving space 43 thereof for receiving the housing 2. The opening 4242 of the second shield member 42 is aligned with the channel 4142 of the first shield member 41.

Referring back to FIG. 2, the cable 6 is a round cable comprising a bundle of wires 60 enclosed in an EMI (Electro Magnetic Interference) shielding 62 which is surrounded by an insulative jacket 64. Each wire 60 is electrically connected to a corresponding terminal 3 through an engagement between the crimping portion 32 of the terminal 3 and a conductive core of the wire 60.

The adapter 5 is made of conductive material such as steel. The adapter 5 has a rectangular base 50 and a cylindrical connecting portion 52 extending perpendicularly rearwardly from the base 50. The adapter 5 defines a cylindrical hole 54 extending through a front face of the base 50 and a rear face of the connecting portion 52. A diameter of the cylindrical connecting portion 52 is slightly smaller than a diameter of the opening 4242. A diameter of the hole 54 is slightly larger than a diameter of the EMI shielding 62 of the cable 6.

In assembly, firstly, the adapter 5 is secured to the second shield member 42 by soldering. The base 50 abuts against the rear wall 424 and is located between the opposite side walls 422. The connecting portion 52 extends outward away from the rear wall 424 through the opening 4242. Secondly, the insulative sleeve 7 is slidably assembled around the cable 6. The cable 6 is extended through the hole 54 of the adapter 5 with the wires 60 positioned in the second shield member 42, and with the EMI shielding 62 in the hole 54 of the adapter 5 and electrically contacting with an inner circumferential face of the connecting portion 52. The sleeve 7 is slid along the cable 6 to fixedly enclose the connecting portion 52 of the adapter 5. Thirdly, the housing 2 with the terminals 3 retained therein is placed in the second shield member 42 with the tab 4262 of the second tongue 4260 fitted in the cutout 27 on the bottom face of the mating portion 20. Each terminal 3 is electrically connected with the corresponding wire 60 of the cable 6. Finally, the first shield member 41 is coupled to the second shield member 42 to form the shielding 4. The tab 4102 of the first tongue 4100 is fitted in the cutout 27 on the top face of the mating portion 20. The side walls 412 of the first shield member 41 are coupled with the side walls 422 of the second shield member 42 by snapping the bulges 4220 into the recesses 4120. The rear wall 414 of the first shield member 41 is coupled with the rear wall 424 of the second shield member 42 by snapping the bulges 4240 into the recesses 4140.

From the above description, the adapter 5, which is connected to the shielding 4, not only secures the cable 6 to the shielding 4 but also electrically interconnects the EMI shielding 62 of the cable 6 with the shielding 4, thereby establishing complete and reliable EMI protection throughout the cable assembly 1. It is noted that the adapter 5 being secured to the shielding 4 by soldering simplifies the assembling process.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable assembly comprising:

an insulative housing and a plurality of terminals received in the housing;

a metallic shielding defining an opening in a wall thereof and a cavity receiving the housing;

a conductive adapter soldered to the wall and having a base residing in the cavity and a connecting portion outside the shielding through the opening; and a cable extending through the adapter into the cavity of the shielding and electrically connecting with the terminals wherein said metalic shielding includes first and second shield members fastened to each other to commonly define a cavity with an L-shaped cross-section along a direction substantially parallel to a mating direction.

2. The cable assembly as claimed in claim 1, wherein the connecting portion of the adapter extends from the base in a direction substantially parallel to the mating direction of the cable assembly.

3. The cable assembly as claimed in claim 1, wherein the adapter defines a cylindrical hole extending therethrough to allow the cable to extend into the cavity of the metallic shielding.

4. The cable assembly as claimed in claim 3, wherein the cable comprises a bundle of wires electrically connecting with the terminals, and an EMI (Electro Magnetic Interference) shielding enclosing the wires and electrically contacting with an inner face of the connecting portion.

5. The cable assembly as claimed in claim 4, wherein the connecting portion is in a cylindrical shape.

6. The cable assembly as claimed in claim 5, further comprising an insulative sleeve fixedly enclosing the connecting portion of the adapter.

7. A cable assembly comprising:

an insulative housing defining a longitudinal direction thereof and having a plurality of terminals received therein;

a metallic shielding including first and second shield members fastened to each other to commonly define a cavity with an L-shaped cross-section along said longitudinal direction, said cavity including thereof a receiving space receiving said housing;

the shielding defining an opening in a front-to-back direction perpendicular to said longitudinal direction;

a conductive adapter received in the cavity and including a connecting portion extending through the opening along said front-to-back direction; and a cable extending through said connecting portion and connecting the corresponding terminals; wherein the housing defines a mating face with a mating direction along the front-to-back direction, and a location of said mating face is offset from that of the opening in a vertical direction perpendicular to both said front-to-back direction and said longitudinal direction wherein the conductive adapter being soldered to a wall of the opening.

8. The cable assembly as claimed in claim 7, wherein interengaging devices of said first and second shield members for fastening said first and second shield members together are located at a position, which is offset from the opening in said vertical direction and is opposite to the location of said mating face along said vertical direction relative to the opening.

* * * * *